US009977365B2

(12) United States Patent
Yago

(10) Patent No.: US 9,977,365 B2
(45) Date of Patent: May 22, 2018

(54) IMAGE FORMING APPARATUS WITH CORRECTION OF EXPOSURE LIGHT USING MEASUREMENT IMAGE

(71) Applicant: CANON KABUSHIKI KAISHA, Tokyo (JP)

(72) Inventor: Toshihisa Yago, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/481,226

(22) Filed: Apr. 6, 2017

(65) Prior Publication Data

US 2017/0307997 A1 Oct. 26, 2017

(30) Foreign Application Priority Data

Apr. 20, 2016 (JP) ..... 2016-084793

(51) Int. Cl.
*G03G 15/00* (2006.01)
*G03G 15/043* (2006.01)

(52) U.S. Cl.
CPC ..... *G03G 15/043* (2013.01); *G03G 15/5058* (2013.01)

(58) Field of Classification Search
CPC ..... G03G 15/043; G03G 15/5033; G03G 15/5041; G03G 15/5054; G03G 15/5058; G03G 15/5062; G03G 2215/00029; G03G 2215/00042; G03G 2215/00059
See application file for complete search history.

(56) References Cited

U.S. PATENT DOCUMENTS

| | | | | |
|---|---|---|---|---|
| 7,609,909 | B2 | 10/2009 | Sasanuma et al. | 382/274 |
| 2016/0077458 | A1* | 3/2016 | Shirafuji | G03G 15/5058 399/49 |
| 2016/0282780 | A1* | 9/2016 | Nakase | G03G 15/5062 |
| 2017/0146922 | A1* | 5/2017 | Wada | G03G 15/043 |
| 2017/0227887 | A1* | 8/2017 | Shirakata | G03G 15/043 |

FOREIGN PATENT DOCUMENTS

JP 2011-133771 7/2011

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes a photosensitive member, an exposing unit exposes the photosensitive member to exposure light to form an electrostatic latent image, a developing unit develops the electrostatic latent image to form an image, an intermediate transfer member onto which the image on the photosensitive member is transferred, a measurement unit measures a measurement image on the intermediate transfer member, an adjustment unit adjusts gradation characteristics based on the measurement result of the measurement unit, and correction unit corrects intensity of the exposure light for each of a plurality of positions on the photosensitive member in a scanning direction. the correction unit corrects the intensity based on the correction amount with respect to the intensity corresponding to a predetermined position. the predetermine position corresponds to a position in the scanning direction, at which the measurement image is formed.

7 Claims, 10 Drawing Sheets

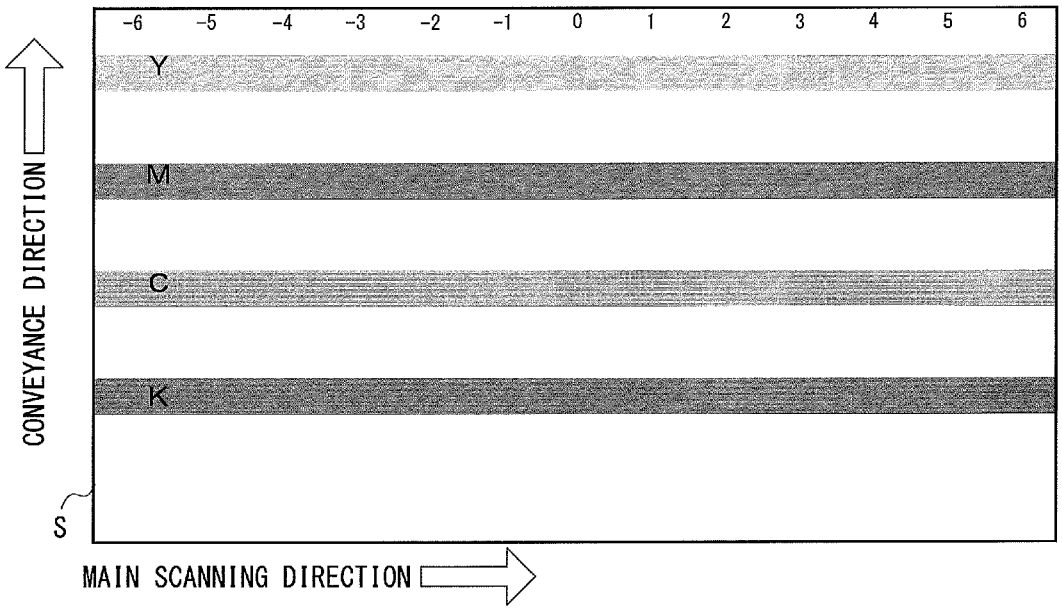
FIG. 6A
| CORRECTION ADDRESS | -6 | -5 | -4 | -3 | -2 | -1 | 0 | 1 | 2 | 3 | 4 | 5 | 6 |
|---|---|---|---|---|---|---|---|---|---|---|---|---|---|
| LIGHT AMOUNT CORRECTION AMOUNT | 4 | 2 | 3 | 5 | 6 | 5 | 3 | 2 | 5 | 6 | 5 | 3 | 5 |
FIG. 6B
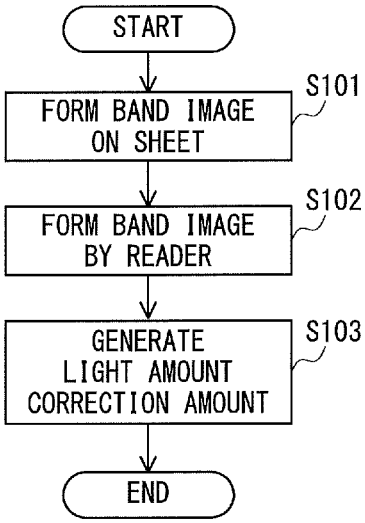
FIG. 7

IMAGE FORMING APPARATUS WITH CORRECTION OF EXPOSURE LIGHT USING MEASUREMENT IMAGE

BACKGROUND OF THE INVENTION

Field of the Invention

The present invention relates to image forming apparatus such as a copying machine, a laser beam printer, and a multi-function printer.

Description of the Related Art

An electrophotographic image forming apparatus includes a photosensitive member, a charging device, an exposing device, a developing device, and a transfer portion to perform image formation. The exposing device is configured to scan the photosensitive member with laser light to form an electrostatic latent image on the photosensitive member. A direction in which the exposing device scans the photosensitive member with the laser light is a main scanning direction. The developing device is configured to develop the electrostatic latent image formed on the photosensitive member to form a toner image on the photosensitive member. The transfer portion is configured to transfer the toner image, which has been formed on the photosensitive member, onto a sheet to form an image on the sheet.

In the image forming apparatus, toner adhesion amounts at different positions on the photosensitive member in the main scanning direction are changed due to sensitivity of the photosensitive member, intensity characteristics of the laser light radiated from the exposing device, development characteristics of the developing device, and other factors. The changes in toner adhesion amounts at different positions in the main scanning direction cause concentration unevenness in an image. In order to correct the toner adhesion amounts on the photosensitive member in the main scanning direction, the image forming apparatus executes shading correction to correct the intensities of laser light in the main scanning direction. Through the shading correction, a correction condition for correction of the intensities of the laser light is determined based on, for example, the toner adhesion amount at a position with the smallest toner adhesion amount in the main scanning direction (U.S. Pat. No. 7,609,909). The correction condition for the shading correction is updated by a user at a suitable timing. The image forming apparatus forms a band-shaped image (band image) elongated in the main scanning direction, acquires information related to the concentrations of the band image, and generates the correction condition for the shading correction based on the information.

Further, when environmental conditions such as temperature and humidity are changed, the image forming apparatus executes gradation correction (calibration) to suppress the change in concentrations of an image to be formed. The image forming apparatus forms a measurement image for measurement of the image concentrations, measures the measurement image by a concentration sensor, and updates gradation characteristics (also called "concentration characteristics") based on a measurement result. Before control for updating the gradation characteristics is executed, the image forming apparatus determines target data of the measurement result from the measurement image.

As described above, the correction condition for the shading correction can be updated by a user at a suitable timing. Therefore, there is a problem in that, when the correction condition for the shading correction is changed after determination of the target data of the measurement result from the measurement image for use in the gradation correction, correction of the image concentrations with high accuracy cannot be performed.

The present invention has been made in view of the above-mentioned problem, and has an object to provide an image forming apparatus which is configured to control image concentrations with high accuracy irrespective of timing of updating correction condition for use in shading correction.

SUMMARY OF THE INVENTION

An image forming apparatus according to the present disclosure includes: a photosensitive member; an exposing unit configured to expose the photosensitive member to exposure light to form an electrostatic latent image on the photosensitive member, wherein the exposure light scans the photosensitive member; a developing unit configured to develop the electrostatic latent image on the photosensitive member to form an image; an intermediate transfer member onto which the image on the photosensitive member is transferred; a measurement unit configured to measure a measurement image transferred onto the intermediate transfer member; an adjustment unit configured to: control the exposing unit and the developing unit to form the measurement image on the photosensitive member; control the measurement unit to measure the measurement image on the intermediate transfer member; and adjust gradation characteristics of an output image based on a measurement result of the measurement unit, wherein the output image to be formed by the image forming apparatus; and a correction unit configured to correct intensity of the exposure light for each of a plurality of positions on the photosensitive member in a scanning direction in which the exposure light scans the photosensitive member, wherein, based on a correction amount for intensity of the exposure light corresponding to another position which is different from a predetermined position included in the plurality of positions in the scanning direction, the correction unit corrects the intensity of the exposure light for each of the plurality of positions, the correction amount being an amount with respect to the intensity of the exposure light corresponding to the predetermined position, and wherein the predetermined position on the photosensitive member in the scanning direction corresponds to a position on the photosensitive member in the scanning direction, at which the measurement image is formed.

Further features of the present invention will become apparent from the following description of exemplary embodiments (with reference to the attached drawings).

BRIEF DESCRIPTION OF THE DRAWINGS

FIG. 6A and FIG. 6B are explanatory views of shading correction.

FIG. 7 is a flowchart for illustrating shading correction processing.

DESCRIPTION OF THE EMBODIMENTS

Embodiments of the present invention are described below in detail with reference to the drawings.

Configuration of Image Forming Apparatus

Figure 1:
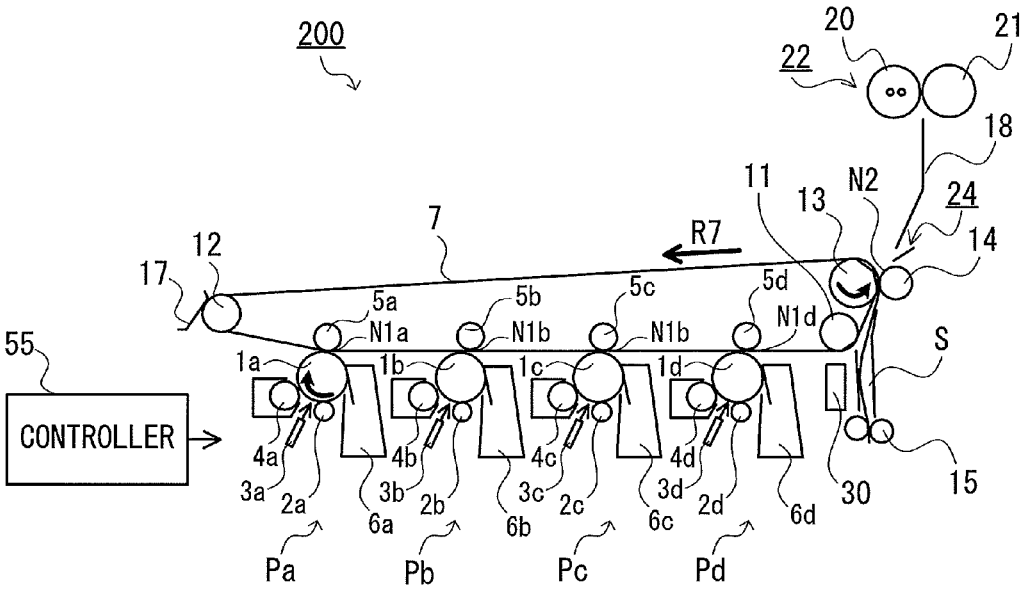
FIG. 1 is a configuration view of a printer.

An image forming apparatus includes a printer 200 and a reader 100. FIG. 1 is a configuration view of the printer 200. The printer 200 includes image forming units Pa to Pd, primary transfer rollers 5*a* to 5*d*, an intermediate transfer belt 7, a secondary transfer portion 24, registration rollers 15, a fixing device 22, and a controller 55. The controller 55 is configured to control an overall operation of the image forming apparatus.

The image forming unit Pa is configured to form a toner image of yellow (Y). The image forming unit Pb is configured to form a toner image of magenta (M). The image forming unit Pc is configured to form a toner image of cyan (C). The image forming unit Pd is configured to form a toner image of black (K). The image forming units Pa to Pd have the same configuration and are different only in colors of toner images to be formed. Details of the configuration of the image forming units Pa to Pd are described later. In the following description, the suffixes a to d are added to ends of the reference symbols when describing distinctive colors. When there is no need to distinguish colors, description is made without the suffixes a to d of the reference symbols.

More specifically, in FIG. 1, each of image forming units Pa to Pd is provided with a photosensitive drum 1, a charging roller 2, an exposing device 3, a developing device 4, a primary transfer roller 5, a cleaner 6, and nip portion N1 formed between the photosensitive drum 1 and the intermediate transfer belt 7. Thus, for image forming units Pa to Pd, there are, respectively, photosensitive drums 1*a* to 1*d*, charging rollers 2*a* to 2*d*, exposing devices 3*a* to 3*d*, developing devices 4*a* to 4*d*, primary transfer rollers 5*a* to 5*d*, cleaners 6*a* to 6*d*, and nip portions N1*a* to N1*d*.

The intermediate transfer belt 7 is an intermediate transfer member onto which the toner images are transferred from the image forming units Pa to Pd. The intermediate transfer belt 7 is made of dielectric resin such as polyimide and formed into an endless shape. The intermediate transfer belt 7 is stretched, on its inner peripheral surface side, around a roller 11, a driven roller 12, and a roller 13, and is rotated in a direction of the arrow R7 by rotation of the roller 11. Nip portions N1*a* to N1*d* are formed between the image forming units Pa to Pd and the intermediate transfer belt 7. Through the nip portions N1*a* to N1*d*, the toner images are primarily transferred onto the intermediate transfer belt 7 in superimposition on one another in a sequential manner from the image forming unit Pa. With this, a full color toner image is formed on the intermediate transfer belt 7. The intermediate transfer belt 7 is rotated to convey the formed toner image to the secondary transfer portion 24. As a member configured to support the intermediate transfer belt 7 from an inner peripheral surface side, a slide member having a simple configuration may be arranged in place of the roller 11.

The secondary transfer portion 24 includes the roller 13 and a roller 14. The roller 14 is arranged at a position corresponding to the roller 13 on an outer peripheral surface side of the intermediate transfer belt 7 while being held in abutment against the intermediate transfer belt 7. A nip portion N2 is formed between the roller 14 and the intermediate transfer belt 7. Through the nip portion N2, the toner image formed on the intermediate transfer belt 7 is secondarily transferred onto a sheet S.

The sheet S is fed from a sheet feeding cassette (not shown) and is conveyed by a conveyance mechanism (not shown) to the registration rollers 15. The registration rollers 15 are configured to perform skew feed correction for the sheet S, and convey the sheet S to the secondary transfer portion at a timing at which the toner image formed on the intermediate transfer belt 7 is conveyed to the secondary transfer portion 24. The roller 14 receives application of secondary transfer bias from a high-voltage power source (not shown) when the sheet S passes through the nip portion N2. The secondary transfer bias has a polarity (positive) which is reverse to charging characteristics (negative) of the toner image. The secondary transfer bias causes the toner image of four colors on the intermediate transfer belt to be secondarily transferred onto the sheet S in a collective manner. Residual toner which is not transferred onto the sheet S and remains on the intermediate transfer belt 7 is removed by a belt cleaner 17 arranged at a position corresponding to the driven roller 12. After the secondary transfer, the sheet S is conveyed along a conveyance guide from the secondary transfer portion 24 to the fixing device 22.

The fixing device 22 includes a fixing roller 20 and a pressure roller 21. A fixing nip portion is formed between the fixing roller 20 and the pressure roller 21. The fixing device 22 is configured to heat and pressurize, at the fixing nip portion, the sheet S having been conveyed along the conveyance guide 18 after the transfer of the toner images. With this, the toner image is fixed on the sheet S. The image forming processing with respect to the sheet S is terminated in such a manner. The sheet S having been subjected to the image formation is delivered from the fixing device 22 to an outside of the printer 200.

In this embodiment, a concentration sensor 30 of a reflective type is arranged at a position corresponding to the roller 11 on the outer peripheral surface side of the intermediate transfer belt 7. The concentration sensor 30 is configured to measure the toner adhesion amounts of the toner image formed on the intermediate transfer belt 7 as image concentrations. The concentration sensor 30 is arranged between the image forming unit Pd and the nip portion N2, thereby being capable of measuring the image concentrations of the toner image immediately after the primary transfer onto the intermediate transfer belt 7.

Figure 2:
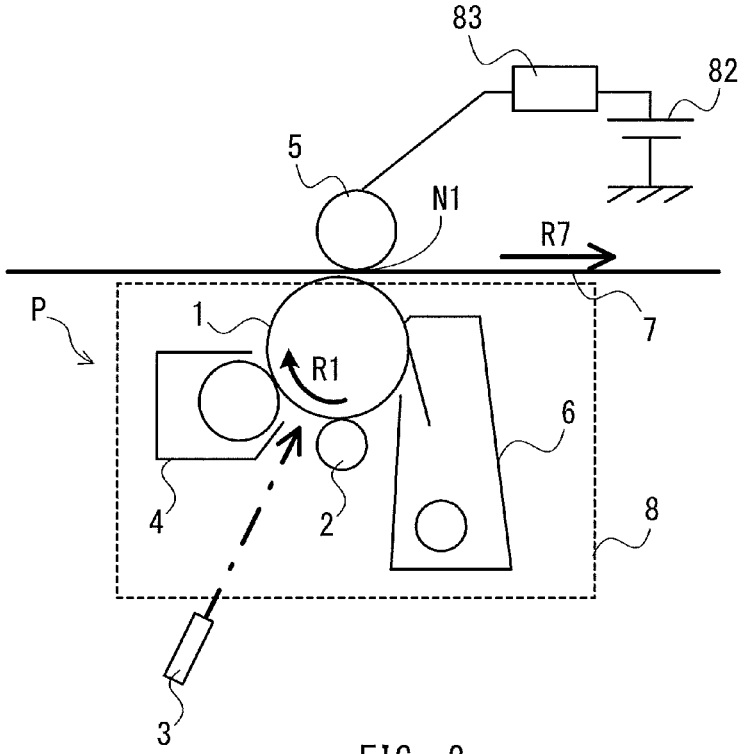
FIG. 2 is an explanatory view of an image forming unit.

FIG. 2 is an explanatory view of the image forming unit P. The image forming unit P includes a photosensitive drum 1, a charging roller 2, a developing device 4, and a cleaner 6. The photosensitive drum 1, the charging roller 2, the developing device 4, and the cleaner 6 are integrally constructed in a cartridge 8. The image forming unit P has a configuration of being removably mounted to a main body of the printer 200 with the cartridge 8. In a periphery of the cartridge 8, the exposing device 3 is arranged. The photosensitive drum 1 is partially exposed to an outside of the cartridge 8 and sandwiches the intermediate transfer belt 7 with the primary transfer roller 5. The nip portion N1 is formed between the photosensitive drum 1 and the intermediate transfer belt 7.

The photosensitive drum 1 is a photosensitive member having a photosensitive layer formed on a surface of a cylinder. The photosensitive drum 1 is driven to rotate at a process speed (peripheral speed) of 100 mm/sec in a direction of the arrow R1 during a constant speed mode. A surface of the photosensitive drum 1 being driven to rotate is charged by the charging roller 2. On the charged surface of the photosensitive drum 1, an electrostatic latent image is formed by laser light radiated from the exposing device 3. The exposing device 3 is a latent image forming unit configured to form the electrostatic latent image through scanning of the photosensitive drum 1 with the laser light in a rotary axis direction. The scanning direction of the laser light is the main scanning direction. The electrostatic latent image is developed by the developing device 4. The charging polarity of the toner for use in the development in this embodiment is negative. A developing device 4*a* of the image forming unit Pa is configured to perform development with yellow toner to form a yellow toner image on a photosensitive drum 1*a*. A developing device 4*b* of the image forming unit Pb is configured to perform development with magenta toner to form a magenta toner image on a photosensitive drum 1*b*. A developing device 4*c* of the image forming unit Pc is configured to perform development with cyan toner to form a cyan toner image on a photosensitive drum 1*c*. A developing device 4*d* of the image forming unit Pd is configured to perform development with black toner to form a black toner image on a photosensitive drum 1*d*.

The toner image formed on the surface of the photosensitive drum 1 is transferred by the primary transfer roller 5 onto an outer peripheral surface of the intermediate transfer belt 7. The primary transfer roller 5 is held in abutment against the intermediate transfer belt 7, and a transfer bias is applied from an electric power supplier 82. An operation of the electric power supplier 82 is controlled by a power supply controller 83. Through the application of the transfer bias from the electric power supplier 82 to the primary transfer roller 5, the toner image formed on the surface of the photosensitive drum 1 is electrostatically transferred onto the outer peripheral surface of the intermediate transfer belt 7 at the nip portion N1. The primary transfer bias in this embodiment is the bias of a DC voltage (DC component) and is bias having a polarity reverse to that of the charging characteristics (regular charging polarity) of the toner.

The residual toner which has not been transferred by the primary transfer onto the intermediate transfer belt 7 and remains on the photosensitive drum 1 is removed by the cleaner 6. The cleaner 6 is configured to remove the residual toner using a cleaning blade and convey the removed residual toner to a waste toner container (not shown) using a waste toner conveyance screw.

Concentration Sensor

The concentration sensor 30 is used when concentration control (toner adhesion amount control) is performed so as to set toner adhesion amounts (concentrations) of an image to desired amounts (concentrations). The concentration sensor 30 measures reflected light amounts from the toner image formed on the outer peripheral surface of the intermediate transfer belt 7 and transmits a measurement result to the controller 55. A position of the concentration sensor 30 is fixed, and hence a predetermined position in a direction orthogonal to a rotating direction of the intermediate transfer belt 7 is a measurement position for image concentrations. The direction orthogonal to the rotating direction of the intermediate transfer belt 7 is the same as the main scanning direction of the photosensitive drum 1. In this embodiment, the measurement position of the concentration sensor 30 is located at a center position in the main scanning direction of the intermediate transfer belt 7.

Figure 3:
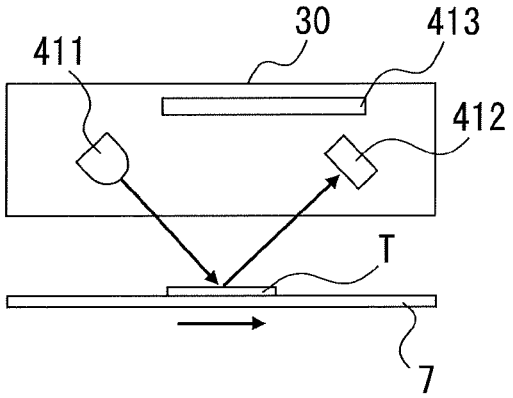
FIG. 3 is a configuration view of a concentration sensor.

FIG. 3 is a configuration view of the concentration sensor 30. The concentration sensor 30 includes a light emitting unit 411, a light receiving unit 412, and a sensor controller 413. The light emitting unit 411 includes a light emitting element such as a light emitting diode (LED) and is configured to irradiate a predetermined position of the intermediate transfer belt 7. The light emitting unit 411 is arranged so that an optical axis of light to be radiated takes an angle of 45 degrees with respect to a normal line of the intermediate transfer belt 7. The light receiving unit 412 includes a light receiving element such as a photodiode and is configured to receive regular reflection light which is light radiated by the light emitting unit 411 and regularly reflected from the intermediate transfer belt 7. The light receiving unit 412 is arranged at a position symmetrical to the light emitting unit 411 with respect to the normal line of the intermediate transfer belt 7 at a light irradiation position of the light emitting unit 411. In FIG. 3, a toner image T passes through the measurement position of the concentration sensor 30. In order to detect flapping of the outer peripheral surface of the intermediate transfer belt 7 with high sensitivity, the concentration sensor 30 uses the regular reflection light for measurement of concentrations.

The sensor controller 413 controls the operation of the concentration sensor 30 to perform light emission amount control for the light emitting unit 411 and transmission of the measurement result of the light receiving unit 412 to the controller 55. The sensor controller 413 is configured to adjust the voltage applied to the light emitting unit 411 to control the light emission amounts of the light emitting unit 411. In a case where the light emission amount differs, the reflection light amount from the same object differs. That is, as the light emission amount is larger, the reflection light amount from the object is larger. The sensor controller 413 controls the concentration sensor 30 to operate at a suitable light amount level when measurement for the concentrations of the toner image T is performed.

The light amount level suitable for the concentration measurement for the toner image T is the light amount which provides good sensitivity with respect to both toner images T with low concentration and high concentration. With regard to the reflection light amount of the toner image T with low concentration, an absolute value of the reflection light amount becomes smaller as the light amount of radiated light is reduced. In this case, there is difficulty in distinguishing the toner image T from gloss unevenness in the outer peripheral surface of the intermediate transfer belt 7. With regard to the reflection light amount of the toner image T with high concentration, the sensitivity with respect to a change in concentration of the toner image T is lowered as the light amount of radiated light is increased. Thus, the light amount level suitable for the concentration measurement of the toner image T is the light amount by which the reflection light amounts of the toner image T with low concentration can be distinguished from the gloss unevenness of the outer surface of the intermediate transfer belt 7 and by which the reflection light amounts of the toner image T with high concentration provide good sensitivity with respect to the change in concentrations of the toner image T.

The sensor controller 413 is configured to adjust the light emitting unit 411 so that the reflection light amounts from the outer peripheral surface of the intermediate transfer belt 7 having no toner image T formed thereon are set to a target light amount level. In this embodiment, the light amount level of the light emitting unit 411 is adjusted so that a measurement result (voltage value) of the light receiving unit 412 in accordance with an average reflection light amount for one rotation of the outer peripheral surface of the intermediate transfer belt 7 is set to 3.5 V±0.1 V. Through the adjustment of such average reflection light amount, even when the glossiness of the outer peripheral surface of the intermediate transfer belt 7 is changed, the sensor controller 413 can correctly control the light emission amount of the light emitting unit 411.

The controller 55 calculates differential amounts (voltage values) between the measurement results (voltage values) of the light receiving unit 412 in accordance with the reflection light amounts from the outer peripheral surface of the intermediate transfer belt 7 and the measurement result (voltage values) of the light receiving unit 412 in accordance with the reflection light amounts from the toner image T formed on the intermediate transfer belt 7, which are acquired from the concentration sensor 30. The controller 55 detects toner adhesion amounts (toner concentrations) of the toner image T based on the calculated differential amounts. In order to form a toner image T having desired toner adhesion amounts, the controller 55 sets image formation conditions for formation of the image having the above-mentioned toner adhesion amounts by the image forming unit P. Specifically, the controller 55 sets image formation conditions such as a charging potential, a developing potential, and an exposure amount in the image forming processing based on the measurement results, which are given by the concentration sensor 30, of the toner adhesion amounts of the toner image T formed on the intermediate transfer belt 7.

Reader

Figure 4:
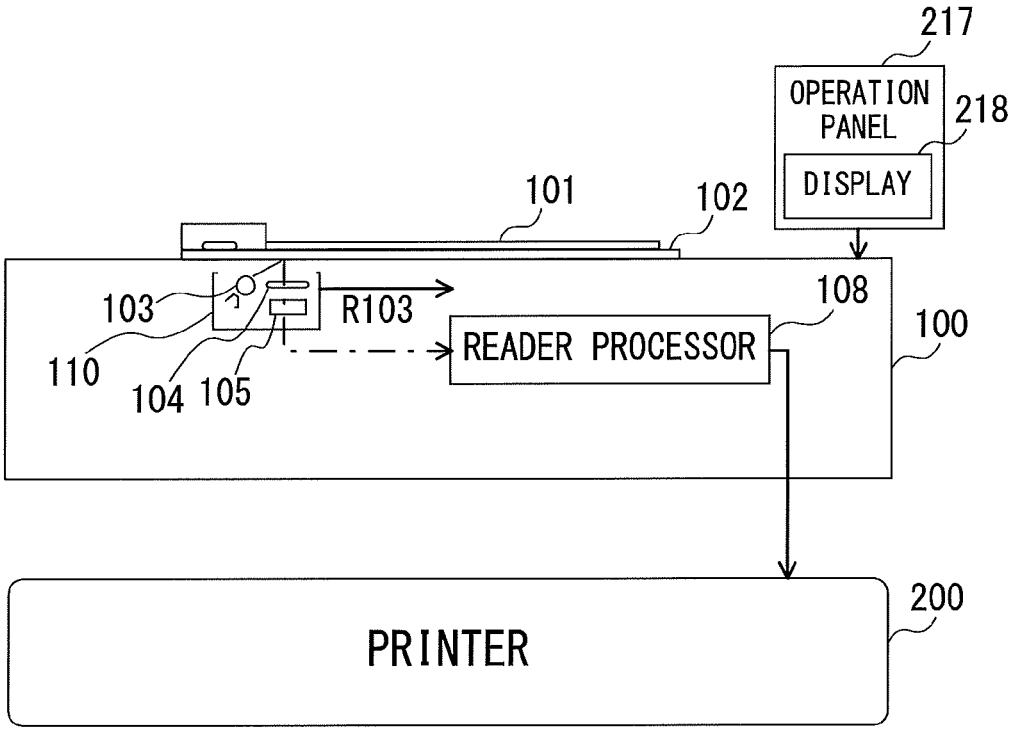
FIG. 4 is a configuration view of a reader.

FIG. 4 is a configuration view of a reader. A reader 100 is a scanner configured to read an image formed on an original 101. The original 101 is placed on an original table 102 so that a surface having the image formed thereon is oriented toward the original table 102 side. The reader 100 transmits image data representing the read image to the printer 200. The reader 100 includes a carriage 110 and a reader processor 108.

The carriage 110 includes a light source 103, a lens 104, and a CCD line sensor 105, which are integrally constructed. The carriage 110 is, for example, a line sensor which extends toward a far side in the drawing sheet, and is configured to read an image from an entire surface of the original 101 while moving in a direction of the arrow R103. The light source 103 is configured to irradiate the original 101 with light. The CCD line sensor 105 is configured to receive light, which is reflected from the original 101, through the lens 104. Light reception results are transmitted to the reader processor 108. The reader processor 108 is configured to generate image data representing the image formed on the original 101 in accordance with the light reception results from the CCD line sensor 105. Further, the reader processor 108 also functions as a sensor configured to measure the image concentrations of the image formed on the original 101 in accordance with the light reception results from the CCD line sensor 105. The reader processor 108 transmits the image data and the measured image concentrations to the controller 55 of the printer 200.

An operation panel 217 is connected to the reader 100. The operation panel 217 is a user interface which is integrally constructed with a display 218. The operation panel 217 includes input buttons and a touch panel as input devices. The operation panel 217 is configured to transmit an input instruction to the controller 55. The display 218 is controlled by the controller 55 to display an image.

Controller

Figure 5A:
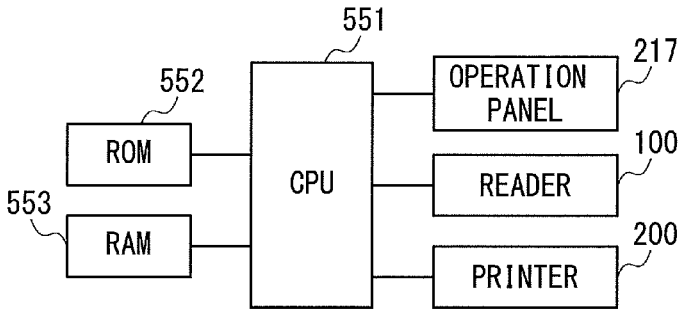
FIG. 5A and FIG. 5B are explanatory diagrams of a controller.
Figure 5B:
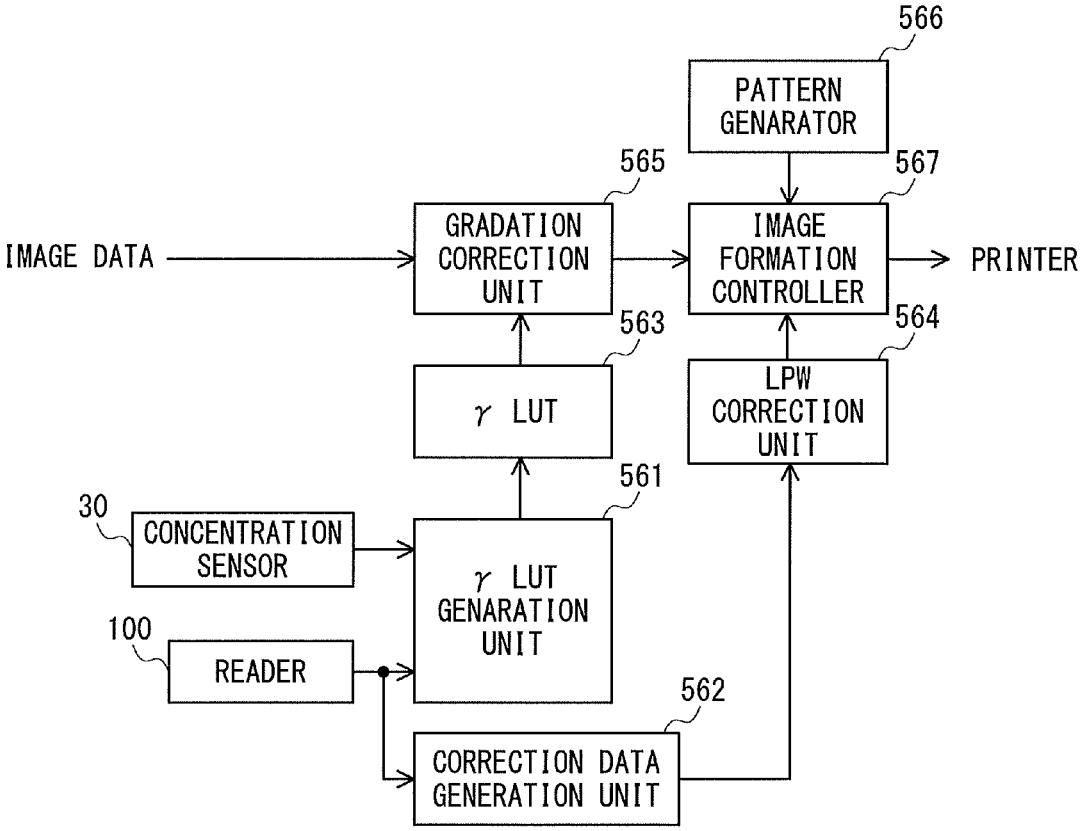

FIG. 5A and FIG. 5B are explanatory diagrams of the controller 55. FIG. 5A is a hardware configuration diagram of the controller 55. The controller 55 is a computer which includes a central processing unit (CPU) 551, a read only memory (ROM) 552, and a random access memory (RAM) 553. The CPU 551 is connected to the operation panel 217. The CPU 551 acquires an instruction input through the operation panel 217. The CPU 551 controls the display 218 of the operation panel 217 to display an image. The CPU 551 is connected to the reader 100 and controls an operation of the reader 100 to acquire the image data and the image concentrations from the reader 100. The CPU 551 is connected to the printer 200 and controls the image forming processing by the printer 200 based on image data acquired from the reader 100 or an external device.

The CPU 551 reads a computer program stored in the ROM 552 and executes the computer program using the RAM 553 as a working area, to thereby control an overall operation of the image forming apparatus. The CPU 551 executes the computer program so that the controller 55 performs operations of functions illustrated in the functional configuration diagram of FIG. 5B. FIG. 5B is an illustration of functions for maintaining a quality of an image to be formed on the sheet S. Description of other operations of the image forming apparatus, for example, a function of performing an operation control for loads such as motors during image formation is omitted.

In this embodiment, the controller 55 performs shading correction and gradation correction to maintain a quality of an image to be formed on the sheet S. For that purpose, the controller 55 functions as a γ look-up table (LUT) generation unit 561, a correction data generation unit 562, a γ LUT 563, a laser power (LPW) correction unit 564, a gradation correction unit 565, a pattern generator 566, and an image formation controller 567. Some or all of the functions of the γ LUT generation unit 561, the correction data generation unit 562, the γ LUT 563, the LPW correction unit 564, the gradation correction unit 565, the pattern generator 566, and the image formation controller 567 may be executed by an application specific integrated circuit (ASIC).

The γ LUT generation unit 561 is configured to acquire the image concentrations measured by the concentration sensor 30 and the image concentrations measured by the reader 100 to generate gradation characteristics based on the acquired image concentrations. The γ LUT generation unit 561 is configured to generate γ correction values, which are conversion conditions for image data to set image concentrations to be close to target data, in accordance with the generated gradation characteristics. The γ LUT generation unit 561 is configured to generate the γ LUT 563 in accordance with the generated γ correction values.

The correction data generation unit 562 is configured to acquire the image concentrations measured by the reader 100 to generate correction data, which corresponds to correction conditions for the shading correction based on the acquired image concentrations. The correction data is data for controlling the light amounts (intensities) of laser light in accordance with positions in the main scanning direction at the time of irradiation of the laser light by the exposing device 3. The correction data generation unit 562 is configured to transmit the generated correction data to the LPW correction unit 564.

The LPW correction unit 564 generates light amount correction amounts of the laser light radiated from the exposing device 3 in accordance with positions in the main scanning direction based on the correction data acquired from the correction data generation unit 562. The intensities of the laser light have a relationship with the image concentrations, and hence the LPW correction unit 564 generates data for correction of the intensities of the laser light in accordance with positions in the main scanning direction.

The gradation correction unit 565 converts image data, which represents an image to be formed, based on the γ LUT 563 to perform the gradation correction. The gradation correction unit 565 transmits image data having been subjected to the gradation correction to the image formation controller 567.

The image formation controller 567 controls an operation of the printer 200 based on the image formation conditions. The image formation controller 567 generates a control signal for the operation of the printer 200, for example, for the light emission control for the laser light radiated from the exposing device 3 in accordance with the image data having been subjected to the gradation correction and the light amount correction amounts for the laser light, and transmits the control signal to the printer 200. The printer 200 performs the light emission control for the exposing device 3 in accordance with the control signal to form an image on the sheet S.

The pattern generator 566 stores image data of a test image which is to be formed when the shading correction and the gradation correction are performed. When the shading correction and the gradation correction are to be performed, the image formation controller 567 reads the image data from the pattern generator 566 and generates the control signal. This image data has not been subjected to the gradation correction.

Shading Correction Control

FIG. 6A and FIG. 6B are explanatory views of the shading correction. Through the shading correction, the controller 55 corrects the concentration unevenness in the main scanning direction when the exposing device 3 scans the photosensitive drum 1 with the laser light. On the photosensitive drum 1, addresses representing positions in the main scanning direction are allocated.

FIG. 6A is a view for illustrating an example of an image to be formed on the sheet S for the shading correction. This image includes band images each formed into a band shape elongated in the main scanning direction for each color (yellow, magenta, cyan, and black). In the band image, there are allocated addresses ranging from −6 to +6 with an address 0 at a center in the main scanning direction. The image data representing the band images is stored in the pattern generator 566. The image formation controller 567 generates a control signal in accordance with the image data of the band images acquired from the pattern generator 566 and controls the printer 200 to form the band images on the sheet S. The image formation controller 567 uses the band images for the shading correction, and hence does not perform correction with respect to the image data in accordance with the light amount correction values.

The band images are set so that the image concentration for each address becomes 0.3, and image formation is performed so that the concentrations are equal at positions in the main scanning direction. When the concentration unevenness in the main scanning direction occurs, the image concentrations of the band image are changed depending on positions (addresses) in the main scanning direction.

FIG. 6B is a table for showing an example of the light amount correction amounts representing correction amounts for the light amounts of the laser light for respective addresses, which are generated as results of the shading correction. Each light amount correction amount is generated by the LPW correction unit 564 of the controller in accordance with measurement results of the image concentration of the band image formed on the sheet S.

FIG. 7 is a flowchart for illustrating the shading correction processing. A user can allow the controller 55 to perform this processing at a suitable timing through an operation to the operation panel 217.

The controller 55 controls the printer 200 to form the band images of FIG. 6A on the sheet S (Step S101). When the band images are formed, the controller 55 does not perform the light amount correction for the laser light in accordance with the light amount correction amounts stored in the LPW correction unit 564. A user places the sheet S having the band images formed thereon on the original table 102 of the reader 100 and instructs, through the operation panel 217, reading of the band images formed on the sheet S. The controller 55 acquires an image reading instruction from the operation panel 217 and instructs the reader 100 to read the images.

The reader 100 acquires the reading instruction from the controller 55 and reads the band images from the sheet S placed on the original table 102. The reader processor 108 measures the image concentrations of the band images from the reading results, associates the image concentrations to the positions in the main scanning direction, and transmits the concentrations to the controller 55. The reader processor 108 calculates an average value of light reception results of the CCD line sensor 105 for each address, for example, having a predetermined width and transmits the calculated average values as the image concentrations. With this, the controller 55 acquires image concentrations corresponding to the respective positions of the band images in the main scanning direction (Step S102).

In accordance with the image concentrations at the predetermined position in the main scanning direction, which is a center position in this embodiment, among image concentrations corresponding to the respective positions of the acquired band images in the main scanning direction, the correction data generation unit 562 of the controller 55 generates correction data for each of other positions (for each of the addresses). The correction data generation unit 562 transmits the generated correction data for each address to the LPW correction unit 564. Based on the acquired correction data for each address, the LPW correction unit 564 generates the light amount correction amount for each address (Step S103). The intensities of the laser light have a relationship with the image concentrations. Thus, based on the intensities of the laser light for exposure of the photosensitive drum 1 at a predetermined position in the main scanning direction, the correction data generation unit 562 generates data for correction of the intensities of the laser light for exposure of other positions. The image formation controller 567 controls the light amounts of the laser light output from the exposing device 3 in accordance with the light amount correction amounts generated in such a manner, to thereby suppress the concentration unevenness of an image in the main scanning direction. That is, the controller 55 corrects the light amounts (intensities) of the laser light in accordance with positions in the main scanning direction so that the toner adhesion amounts on the photosensitive drum 1 in the main scanning direction are fixed.

Hitherto, at the time of shading correction, correction data is generated based on an image concentration at a position with the smallest concentration among image concentrations of the band images at positions in the main scanning direction. In contrast, according to this embodiment, the correction data is generated based on image concentrations (intensities of laser light) of an address at a center in the main scanning direction. This is because, at the time of gradation correction described later, a γ correction value is generated in accordance with the image concentration of the address at the center in the main scanning direction. That is, a measurement position of the concentration sensor 30 is located at the address at the center in the main scanning direction. When the measurement position of the concentration sensor 30 is located at another position in the main scanning direction, a position of the image concentration serving as a reference for generation of the correction data is located at the same position as the measurement position of the concentration sensor 30.

Gradation Correction Control

The gradation correction includes processing to be performed at the time of manufacture or introduction of the image forming apparatus and at the time of change in an installation environment (first calibration) and processing to be performed each time image formation is performed for a predetermined number of sheets or regularly performed at the time of change in an environmental condition (second calibration).

First Calibration

Figure 8:
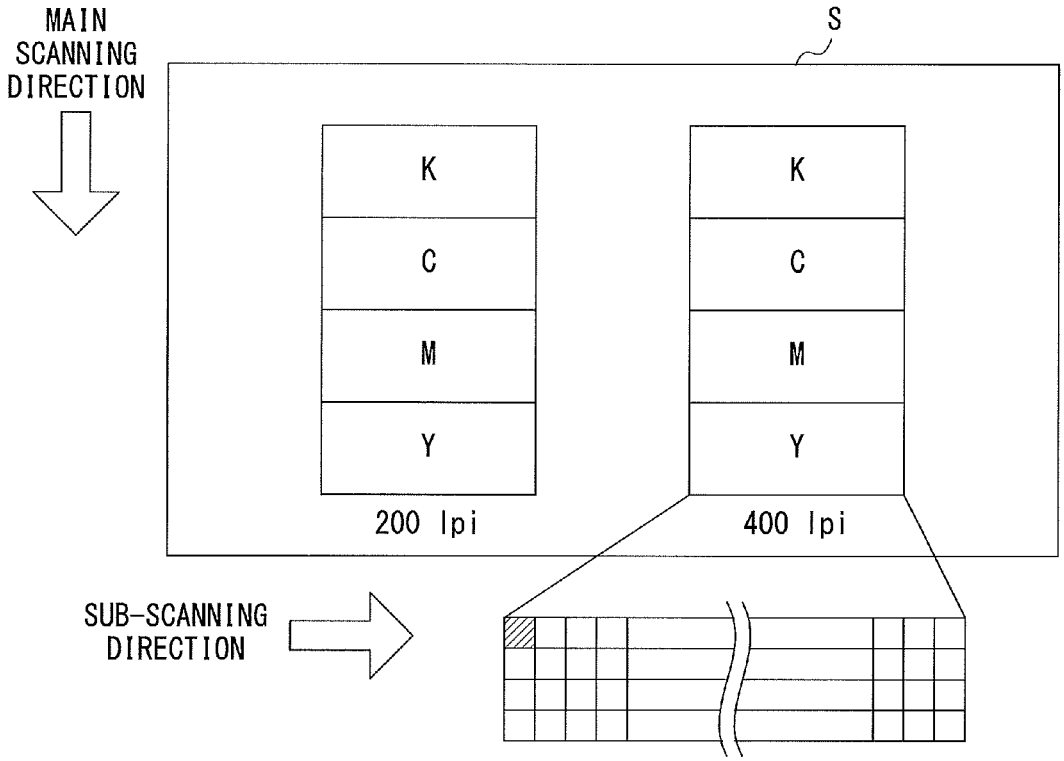
FIG. 8 is a view for illustrating an example of a test image for use in calibration.
Figure 9:
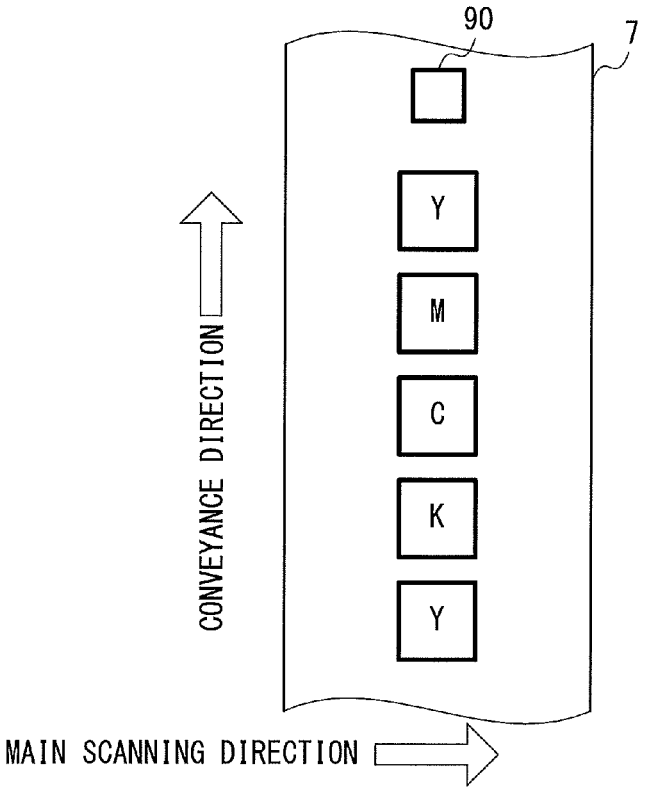
FIG. 9 is a view for illustrating an example of a test image for use in calibration.

FIG. 8 and FIG. 9 are views for illustrating examples of test images for use in the calibration.

FIG. 8 is a view for illustrating an example of a pattern image to be formed on the sheet S. In the pattern image, patterns of yellow (Y), magenta (M), cyan (C), and black (K) are independently formed in the main scanning direction. The pattern for each color is an image having a predetermined number of gradations, for example, 4 columns and 16 rows (64 gradations). In the pattern image, patterns having resolutions of 200 lpi (line per inch) and 400 lpi are formed for each color in a sub-scanning direction. The image concentrations of the pattern image are measured by the reader 100.

FIG. 9 is a view for illustrating an example of a measurement image to be formed on the intermediate transfer belt 7. The image concentrations of the measurement image are measured by the concentration sensor 30. The measurement image having been subjected to the measurement for the image concentrations is not transferred onto the sheet S and is removed by the belt cleaner 17. A plurality of measurement images are formed for each color in alignment along the conveyance direction of the image on the intermediate transfer belt 7. The measurement image is conveyed to a measurement position 90 on the intermediate transfer belt 7. The measurement position 90 corresponds to a position on the intermediate transfer belt 7 where the light from the light emitting position 411 of the concentration sensor 30 is radiated. The measurement position 90 of the concentration sensor 30 in this embodiment is located at a center in the main scanning direction. Thus, the measurement image of each color is formed at a center of the intermediate transfer belt 7 in the main scanning direction. The measurement image for each color is an image having a predetermined number of gradations, for example, 4 columns and 16 rows (64 gradations).

Figure 10:
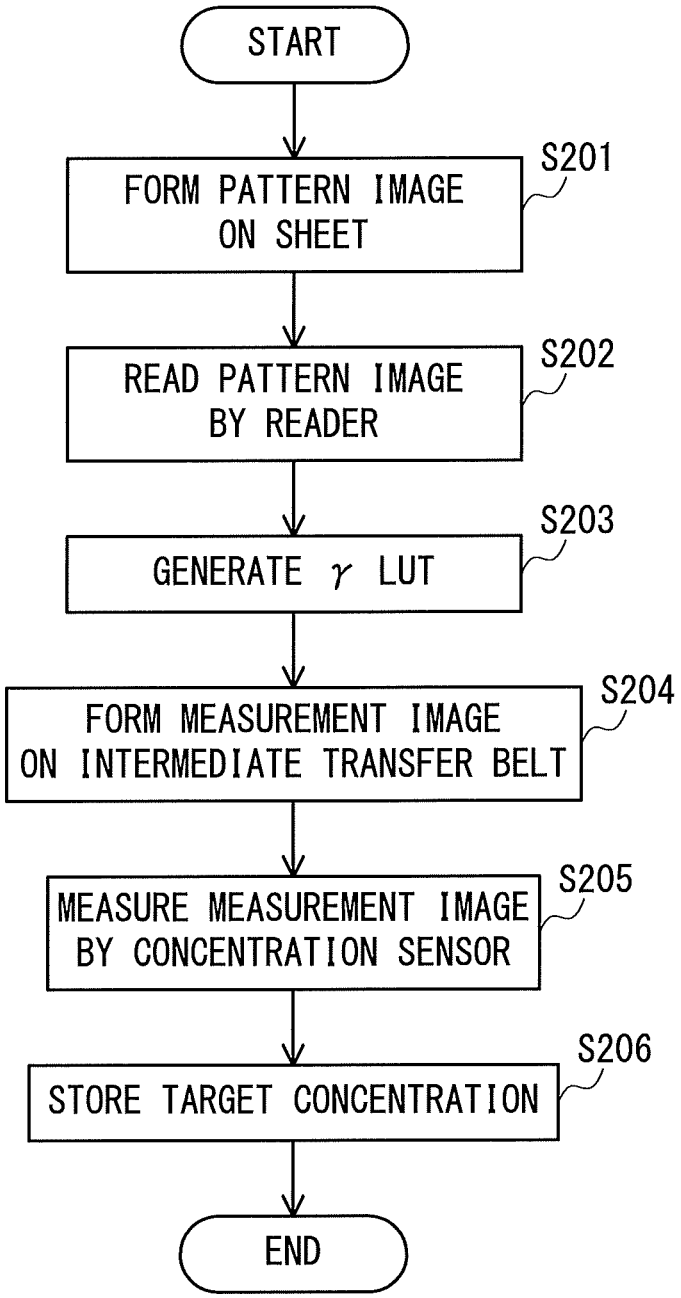
FIG. 10 is a flowchart for illustrating first calibration.

FIG. 10 is a flowchart for illustrating the first calibration. During the first calibration, the controller 55 generates the γ LUT 563 for determination of a target concentration being target data of the concentration of the image to be formed on the sheet S.

The controller 55 controls the printer 200 to form the pattern image of FIG. 8 on the sheet S (Step S201). When the pattern image is formed, the image formation controller 567 of the controller 55 corrects the light amount of the laser light based on the light amount correction amounts stored in the LPW correction unit 564. A user places the sheet S, which has the pattern image formed thereon, onto the original table 102 of the reader 100 and instructs, through the operation panel 217, reading of the band image formed on the sheet S. The controller 55 acquires the image reading instruction from the operation panel 217 and instructs the reader 100 to read the image.

The reader 100 acquires the reading instruction from the controller 55 and reads the pattern image from the sheet S placed on the original table 102. The reader processor 108 measures the image concentrations of the read pattern image and transmits the image concentrations to the controller 55. In such a manner, the controller 55 acquires the image concentrations of the pattern image (Step S202). The γ LUT generation unit 561 generates the gradation characteristics based on the image concentrations of the pattern image and generates the γ LUT 563 in accordance with the generated gradation characteristics (Step S203).

When the generation of the γ LUT 563 is terminated, the controller 55 controls the printer 200 to form the measurement image of FIG. 9 on the intermediate transfer belt 7 (Step S204). When the measurement image is formed, the controller 55 does not perform the light amount correction to the laser light in accordance with the light amount correction amounts stored in the LPW correction unit 564. The concentration sensor 30 measures the image concentrations of the measurement image formed on the intermediate transfer belt 7 (Step S205). The measurement results are input to the γ LUT generation unit 561. The γ LUT generation unit 561 generates the target concentration in accordance with the image concentration of the measurement image and stores the target concentrations in a nonvolatile memory (not shown) (Step S206). The gradation correction unit 565 performs the gradation correction using the γ LUT 563 with the target concentration as target data.

The target data is stored in advance in the nonvolatile memory at the time of factory shipment of the image forming apparatus, and is updated to the target concentration generated in Step S206. After the factory shipment, when the first calibration is performed at the time of installation, and the γ LUT 563 is generated in the processing of Step S203, the target data, which has been stored in the nonvolatile memory at the time of factory shipment, is used.

Second Calibration

Figure 11:
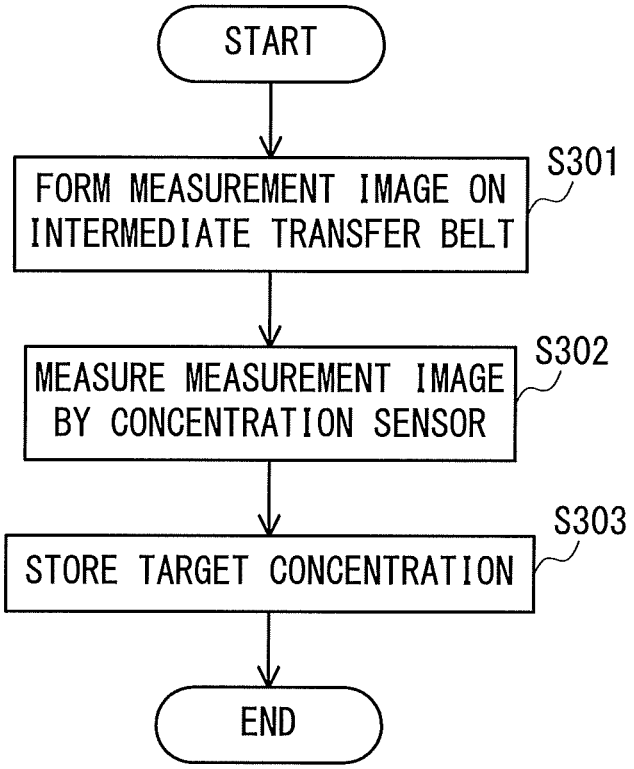
FIG. 11 is a flowchart for illustrating second calibration.

FIG. 11 is a flowchart for illustrating the second calibration. During the second calibration, the controller 55 determines the target concentration being the target data for the concentration of the image to be formed on the sheet S. During the second calibration, the measurement image of FIG. 9 is used.

The controller 55 controls the printer 200 to form the measurement image of FIG. 9 on the intermediate transfer belt 7 (Step S301). When the measurement image is formed, the controller 55 does not perform the light amount correction of the laser light based on the light amount correction amounts stored in the LPW correction unit 564. The concentration sensor 30 measures the image concentration of the measurement image formed on the intermediate transfer belt 7 (Step S302). The measurement result is input to the γ LUT generation unit 561. The γ LUT generation unit 561 generates the target concentration in accordance with the image concentration of the measurement image and stores the target concentration in the nonvolatile memory (Step S303). The gradation correction unit 565 performs the gradation correction using the γ LUT 563 with the target concentration as the target data. Through update of the target data, the fluctuation of image quality depending on the change in environment can be suppressed.

Effect

Figure 12:
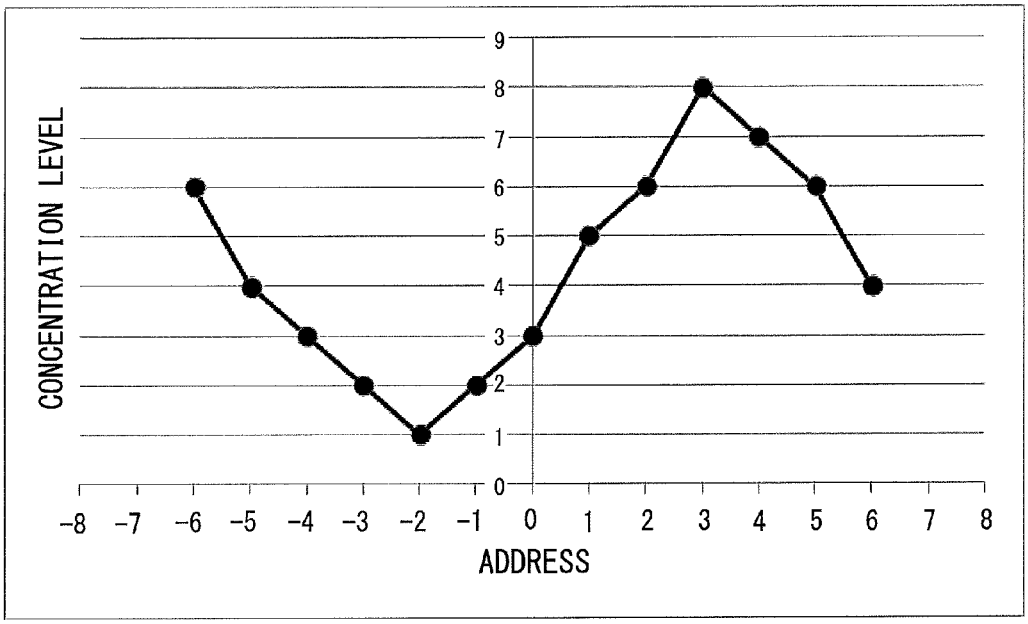
FIG. 12 is a graph for showing an example of image concentrations at respective addresses in a main scanning direction.

As a result of the generation of the correction condition and conversion condition using the image concentration of the image formed at the same position by the shading correction and the first and second calibrations in the manner as described above, the following effect can be obtained. FIG. 12 is a graph for showing an example of image concentrations at addresses in the main scanning direction under a state in which the correction such as the shading correction or the calibration is not performed. The concentration unevenness in the main scanning direction is not corrected, with the result that the fluctuation in the image concentration (concentration levels) becomes larger. With regard to the image forming apparatus having such characteristics, description is made of a case where correction is made based on an image concentration of the image at the "address 0" which is the measurement position of the concentration sensor 30 and a case where the correction is performed based on the image concentration of the image at another position, which is the "address +6".

Figure 13:
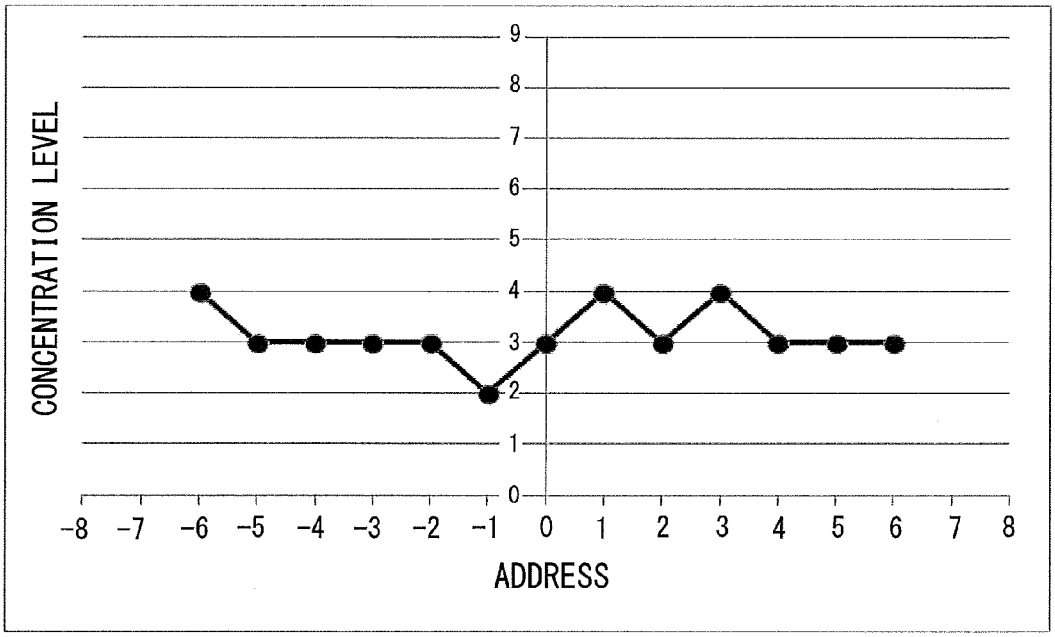
FIG. 13 is a graph for showing an example of image concentrations at respective addresses in the main scanning direction.
Figure 14:
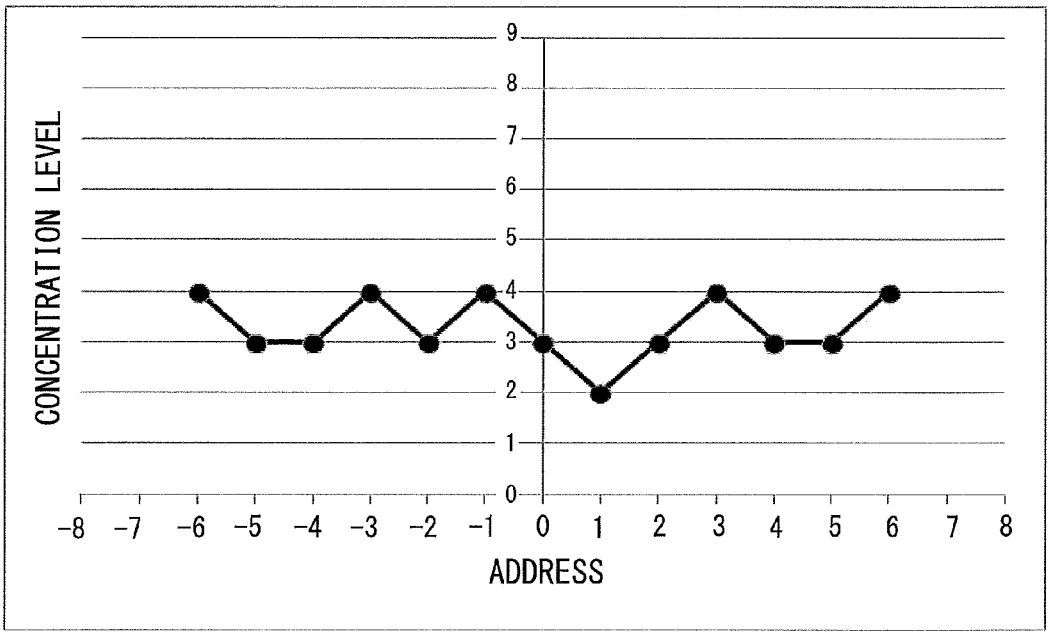
FIG. 14 is a graph for showing an example of image concentrations at respective addresses in the main scanning direction.

FIG. 13 is a graph for showing an example of image concentrations at addresses in the main scanning direction in the case where the correction is performed based on the image concentration at the "address 0". FIG. 14 is a graph for showing an example of image concentrations at addresses in the main scanning direction in the case where the correction is performed based on the image concentration at the "address +6". With regard to the concentration unevenness immediately after the correction, fluctuation is suppressed in both cases. The concentration unevenness is changed by influences such as the number of times the image forming operation is performed and the environmental changes. With respect to such changes, the image forming apparatus stabilizes the image quality through the second calibration.

Figure 15:
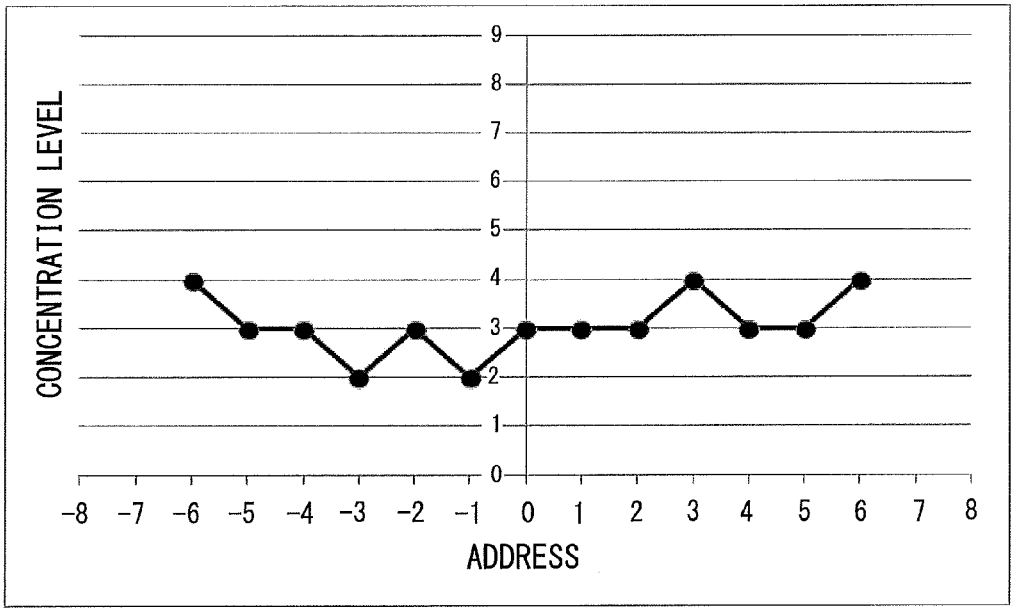
FIG. 15 is a graph for showing an example of image concentrations at respective addresses in the main scanning direction.

FIG. 15 is a graph for showing an example of image concentrations at addresses in the main scanning direction after the image forming operation is performed for 10,000 sheets from the state of FIG. 13. As shown in FIG. 15, it can be found that, even when there are changes in conditions and changes in an environment due to the using the image forming apparatus, the evenness in image concentration is maintained through the second calibration without any change in color tones.

Figure 16:
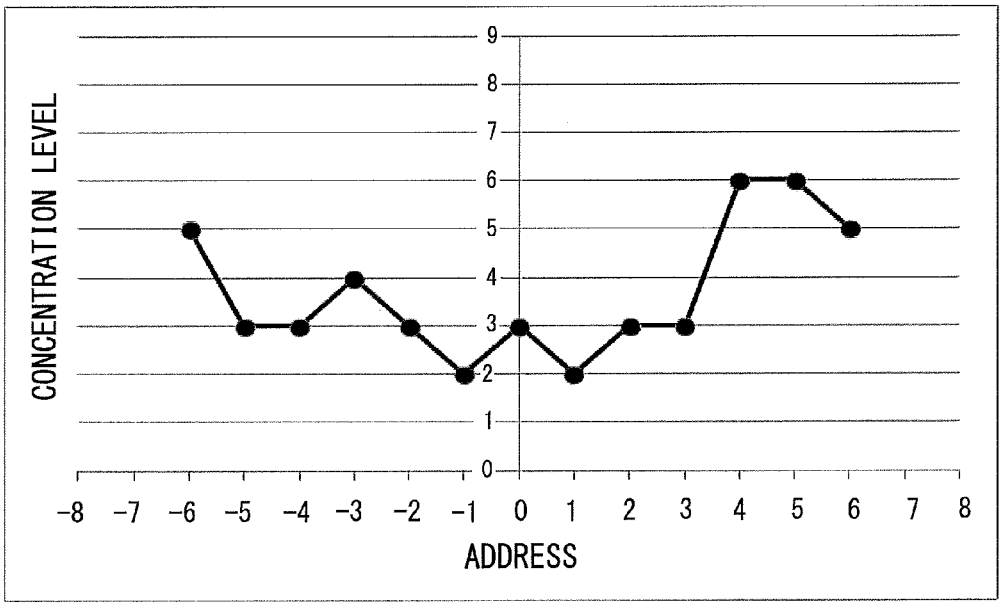
FIG. 16 is a graph for showing an example of image concentrations at respective addresses in the main scanning direction.

FIG. 16 is a graph for showing an example of image concentrations at addresses in the main scanning direction after the image forming operation is performed for 10,000 sheets from the state of FIG. 14. As shown in FIG. 16, the change in the image concentration is small at the measurement position (address 0) of the concentration sensor 30. However, at positions farther from the concentration sensor 30 in the main scanning direction, the fluctuation becomes larger. Even when the shading correction is performed at the "address +6", that is, in the vicinity of an end in the main scanning direction, the position is far from the detection position of the concentration sensor 30 for the image control, and hence the unevenness in image density may occur in the state closer to the state of the original concentration unevenness.

As described above, according to this embodiment, the shading correction is performed based on the image concentrations of the image at the measurement position of the concentration sensor 30. As a result, even when there are changes in conditions and changes in environment due to the use of the image forming apparatus, the evenness in image concentration is maintained through the calibration.

According to the present invention, based on the intensity of the laser light for exposure of a predetermined position corresponding to the position on the photosensitive member where the electrostatic latent image of the measurement image is formed in the laser light scanning direction, the intensities of the laser light for exposure of other positions are corrected. Therefore, the image concentrations can be controlled with high accuracy irrespective of update timings for the correction conditions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-084793, filed Apr. 20, 2016 which is hereby incorporated by reference herein in its entirety.

What is claimed is:

1. An image forming apparatus comprising:

a photosensitive member;

an exposing unit configured to expose the photosensitive member to exposure light to form an electrostatic latent image on the photosensitive member, wherein the exposure light scans the photosensitive member;

a developing unit configured to develop the electrostatic latent image on the photosensitive member to form an image;

an intermediate transfer member onto which the image on the photosensitive member is transferred;

a measurement unit configured to measure a measurement image transferred onto the intermediate transfer member;

an adjustment unit configured to:

control the exposing unit and the developing unit to form the measurement image on the photosensitive member;

control the measurement unit to measure the measurement image on the intermediate transfer member; and adjust gradation characteristics of an output image based on a measurement result of the measurement unit, wherein the output image to be formed by the image forming apparatus; and a correction unit configured to correct intensity of the exposure light for each of a plurality of positions on the photosensitive member in a scanning direction in which the exposure light scans the photosensitive member, wherein, based on a correction amount for intensity of the exposure light corresponding to another position which is different from a predetermined position included in the plurality of positions in the scanning direction, the correction unit corrects the intensity of the exposure light for each of the plurality of positions, the correction amount being an amount with respect to the intensity of the exposure light corresponding to the predetermined position, and wherein the predetermined position on the photosensitive member in the scanning direction corresponds to a position on the photosensitive member in the scanning direction, at which the measurement image is formed.

2. The image forming apparatus according to claim 1, further comprising a conversion unit configured to convert image data based on a gradation correction condition, wherein the adjustment unit generates the gradation correction condition based on the measurement result of the measurement unit.

3. The image forming apparatus according to claim 1, further comprising an acquisition unit configured to acquire information related to a concentration of a band image formed on a sheet by the image forming apparatus, wherein a longitudinal direction of the band image corresponds to the scanning direction, and wherein the correction unit determines the correction amount based on the information acquired by the acquisition unit.

4. The image forming apparatus according to claim 3, wherein a length of the measurement image in the scanning direction is smaller than a length of the band image in the scanning direction.

5. The image forming apparatus according to claim 3, further comprising a reading unit configured to read the band image, wherein the acquisition unit acquires the information based on a reading result of the reading unit.

6. The image forming apparatus according to claim 1, wherein the adjustment unit controls the exposing unit and the developing unit to form the measurement image without correction of the intensity of the exposure light by the correction unit.

7. The image forming apparatus according to claim 1, wherein the correction unit corrects intensity of the exposure light to correct a toner adhesion amount on the photosensitive member in the scanning direction.

* * * * *